US006284993B1

(12) United States Patent
Ledru

(10) Patent No.: US 6,284,993 B1
(45) Date of Patent: Sep. 4, 2001

(54) BALL-LOCKED MECHANISM FOR INSERTING A CLOSURE RESISTOR

(75) Inventor: Roger Ledru, Tignieu (FR)

(73) Assignee: Alstom Holdings, Paris (FR)

( * ) Notice: Subject to any disclaimer, the term of this patent is extended or adjusted under 35 U.S.C. 154(b) by 0 days.

(21) Appl. No.: 09/449,473

(22) Filed: Nov. 29, 1999

(30) Foreign Application Priority Data

Nov. 30, 1998 (FR) ..... 98 15035

(51) Int. Cl.[7] ..... H01H 33/02; H01H 33/16
(52) U.S. Cl. ..... 218/154; 218/143
(58) Field of Search ..... 218/143–145, 218/154

(56) References Cited

U.S. PATENT DOCUMENTS 4,324,959 4/1982 Hall et al. ..... 218/143
4,338,500 7/1982 Pham Van et al. ..... 218/143

FOREIGN PATENT DOCUMENTS 2 553 926 A1 4/1985 (FR) .

*Primary Examiner*—J. R. Scott
(74) *Attorney, Agent, or Firm*—Sughrue, Mion, Zinn, Macpeak & Seas, PLLC

(57) ABSTRACT

A mechanism for inserting a closure resistor serves for an electrical switch which contains a semi-moving arcing contact secured to a metal rod connected to the resistor. The mechanism includes a metal tube mounted to slide on the rod and carrying fingers that plug onto a conductive plug of the switch. A switch is disposed between a shoulder provided on the rod and a shoulder provided on the tube so as to be compressed during a first stage of switch opening, and so as to exert a return force on the tube to displace it in the axial direction in order to separate the fingers from the plug during a second stage of switch opening. The mechanism also includes a system having at least one ball which locks the tube so as to prevent it from being displaced in the axial direction during the first opening stage, and which retracts during the second opening stage so as to release the tube so that it can be displaced.

4 Claims, 8 Drawing Sheets

BALL-LOCKED MECHANISM FOR INSERTING A CLOSURE RESISTOR

FIELD OF THE INVENTION

The invention relates to a mechanism for inserting a resistor in an electrical switch during closure of said switch so as to limit the effects of the capacitive currents present on the line of the switch. More particularly, the invention relates to a mechanism for inserting a closure resistor for a high-voltage metal-clad circuit-breaker. This type of switch comprises a metal casing which extends in an axial direction, which is generally made of sheet aluminum, and is filed with a dielectric gas, and in which two moving contact assemblies are mounted to move in the axial direction, namely a moving permanent contact assembly and a moving arcing contact assembly. One of the two contact assemblies is semi-moving in that its displacement in the axial direction is co-ordinated with the displacement of the other contact assembly via a linkage or a motion-transferring system. In order to equip that type of switch with a mechanism for inserting a closure resistor while modifying the structure of the interrupting chamber of the switch as little as possible, provision is made to extend the semi-moving arcing contact with a metal rod that extends in the axial direction between the arcing contact and the resistor.

BACKGROUND OF THE INVENTION

Conventional mechanisms comprise a metal tube coaxial with the rod and mounted to slide in electrical contact thereon, and having an end that plugs onto a conductive plug of the switch so as to short-circuit the resistor. The end of the tube that plugs onto the conductive plug is formed of a thimble of flexible fingers. A spring is disposed between a first shoulder provided on the rod and a second shoulder provided in the tube so as to be compressed during a first stage of switch opening, and so as to exert a return force on the tube to displace it in said direction in order to separate it form the plug during a second stage of switch opening subsequent to the first stage. When the switch is closed, the thimble of fingers of the metal tube is plugged onto the conductive plug which is normally connected to a terminal of the switch. During opening, it is important that the thimble of fingers on the metal tube does not come unplugged from the conductive plug before the contacts of the switch are fully separated. That is why the mechanism for inserting the resistor is designed so that the force form the compressed spring always remains lower than the tube-unplugging force, the tube being unplugged by the rod of the semi-moving contact coming into abutment in the axial direction against the metal tube.

In addition to the fact that the force at the flexible fingers of the metal tube is difficult to control, wear on the fingers over time gives rise to a loss of reliability of the mechanism for inserting the closure resistor.

OBJECTS AND SUMMARY OF THE INVENTION

An object of the invention is to remedy those drawbacks.

To this end, the invention provides a mechanism for inserting a closure resistor for an electrical switch containing a semi-moving arcing contact mounted to be semi-movable in an axial direction and secured to a metal rod which extends in the axial direction between the arcing contact and the resistor, the mechanism comprising: a metal tube coaxial with the rod and mounted to slide in electrical contact thereon, and having an end that plugs onto a conductive plug of the switch so as to short-circuit the resistor; and a spring disposed between a first shoulder provided on the rod and a second shoulder provided on the tube to displace it in the axial direction in order to separate it from the plug during a second stage of switch opening subsequent to the first stage, the mechanism further comprising a system having at least one ball which locks the tube so as to prevent it from being displaced in the axial direction during the first opening stage, and which retracts during the second opening stage so as to release the tube so that it can be displaced in the axial direction.

BRIEF DESCRIPTION OF THE DRAWINGS

The mechanism of the invention for inserting a closure resistor is described in detail below with reference to the drawings, in which.

MORE DETAILED DESCRIPTION

Figure 1:
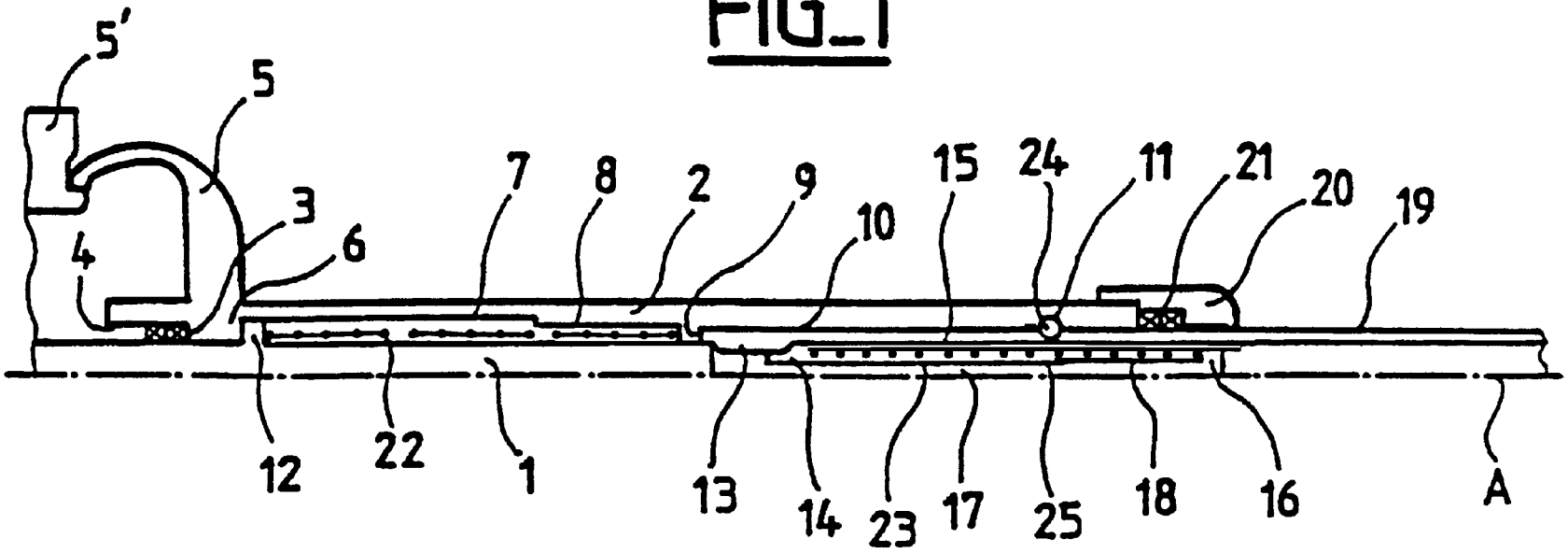
FIGS. 1 to 4 are very diagrammatic views of the mechanism for inserting the resistor during various stages of switch opening.

The mechanism of the invention for inserting a resistor is designed in particular for equipping a metal-clad high-voltage circuit-breaker comprising two contact assemblies mounted to move relative to each other in an axial direction A and not shown on the left of the figures. One of the contact assemblies is mounted to be semi-movable in said direction, and it comprises an arcing contact extended by a metal rod 1 that extends between the arcing contact and a closure resistor not shown on the right of the figures.

The insertion mechanism of the invention is disposed in line with the interrupting chamber of the circuit-breaker and behind the semi-moving arcing contact. As shown in the figures, this mechanism comprises a metal tube 2 which is coaxial with the rod 1 and which is mounted to slide thereon. The tube 2 is in electrical contact with the rod 1 via sliding contacts 3 surrounding the rod 1 and disposed in a first bore 4 in the tube 2. That end of the tube 2 which faces the interrupting chamber of the circuit-breaker carries a thimble of flexible fingers 5 which plug onto a conductive plug 5' connected electrically to a terminal of the circuit-breaker.

Going from left to right in the Figures, the tube 2 is thus provided with a first annular bore 4 followed by a first annular shoulder 6 extending radially towards the axis A, followed by a second annular bore 7 with a step 8 returning towards the axis A, followed by a second annular shoulder 9 extending towards the axis A, followed finally by a third annular bore 10 in which an annular groove 11 is provided.

Going from left to right, the rod 1 is provided with a collar (annular shoulder) 12 which is placed along the rod so as to be displaced between the shoulder 6 in the tube 2 and the step 8 therein, followed by an annular groove 13 which is placed along the rod so as to be displaced between the shoulder 9 and the groove 11 in the metal tube 2.

The rear edge of the groove 13 is constituted by a rounded end of a substantially frustoconical tubular piece 14 which is coaxial with the rod and which is disposed between the rod and the bore 10 in the tube 2. The tubular piece 14 is provided with an annular bore 15 whose end wall faces the rounded end, so that the bore 15 comes into abutment against an annular shoulder 16 on the end of the rod 1. The shoulder 6 is preferably constituted by a separate part, thereby making it easier to mount the various elements of the mechanism about the rod 1. Between the groove 13 and the shoulder 16, the rod is further provided with two steps 17 and 18, the rounded end of the tubular piece 14 sliding on the surface of the first step 17 of the rod 1 in the direction A.

Another tube 19 that is stationary in the direction A and that is coaxial with the rod 1 is dispose between the bore 10 and the tubular piece 14. The rear end of the tube 2 is closed by a socket 20 through which the tube 19 passes coaxially. Sliding contacts 21 are disposed between the socket 20 and the tube 19 so as to enable current to flow from the tube 2 to the tube 19 which is connected electrically to the resistor.

A first compression spring 22 is disposed between the shoulder 12 on the rod 1 and the shoulder 9 in the tube 1. A second compression spring 23 is disposed between the end wall of the bore 15 in the tubular piece 14 and the shoulder 16 on the rod 1.

In the insertion mechanism of the invention for inserting the resistor, the tube 2 is locked so that it is prevented from being displaced in the direction A by a system comprising one or more retractable balls 24. More particularly, when the circuit-breaker is closed, each ball 24 is engaged in the groove 11 in the tube 2 and in a hole 25 in the tube 19 facing the groove, the ball 24 resting on the cylindrical outside surface of the tubular piece 14. In the figures, a single ball is shown but it should be understood that the abutment is preferably provided with a plurality of balls distributed over the circumference of the annular groove 11 and facing a plurality of holes 25 also distributed over the circumference of the tube 19. During opening, the rod 1 is displaced in the direction A from left to right as shown in the figures, and, when the groove 13 in the rod 1 is facing the hole 25 in the tube 19, the ball 24 retracts into the groove 13 so as to release the tube 2 so that it can be displaced in the direction A. It should be understood that the tube 2 is unlocked only after the contacts of the circuit-breaker have completely separated, corresponding to the rod 1 being displaced over a certain distance. With the retractable-ball system of the invention, it is not necessary to control the force exerted by the fingers 5 of the tube 2 on the plug 5'. The unplugging takes place when the shoulder 12 on the rod 1 entrains the tube 2 via the shoulder 8 over a stroke that is long enough in the axial direction A.

The insertion mechanism of the invention for inserting a closure resistor operates as follows:

In FIG. 1, the circuit-breaker is cloned The fingers 5 are plugged onto the plug 5'. The resistor is short-circuited because the current flows from the semi-moving arcing contact to a terminal of the circuit-breaker via the rod 1, the sliding contacts 3, the metal tube 2, the fingers 5, and the conductive plug 5'. The ball 24 is engaged in the groove 11 in the tub 2, and in a hole 25 in the tube 19, and the tube 2 is therefore locked so that it is prevented from being displaced in the direction A. The spring 22 is relaxed between the two shoulders 6 and 9, and the spring 23 is relaxed between the end wall of the bore 15 and the shoulder 16. The rounded end of the tubular piece 14 bears against the edge of the step 17 that is closer to the groove 13.

Figure 2:
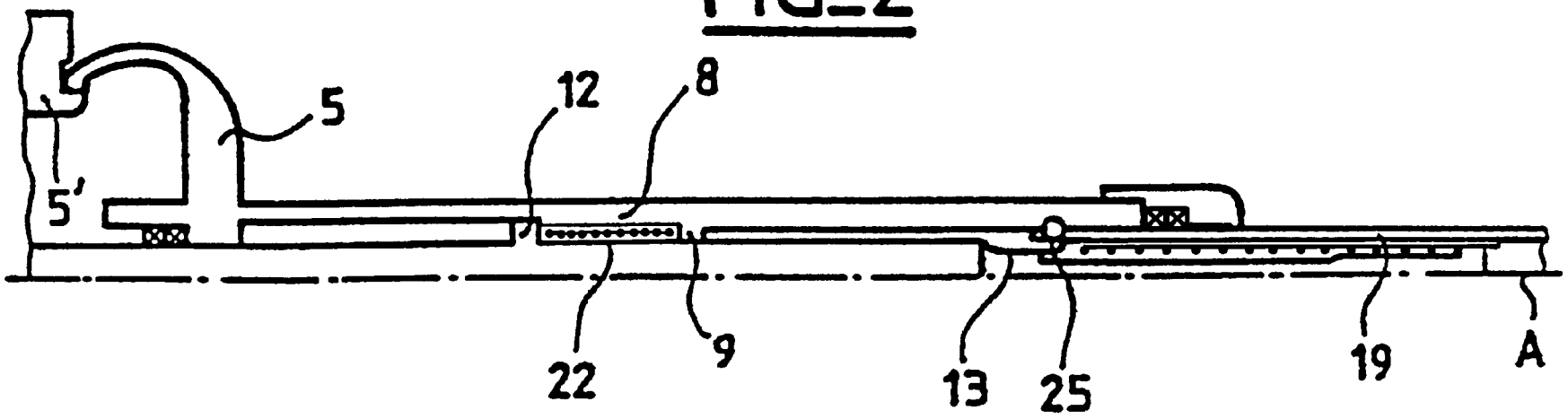
Figure 8:
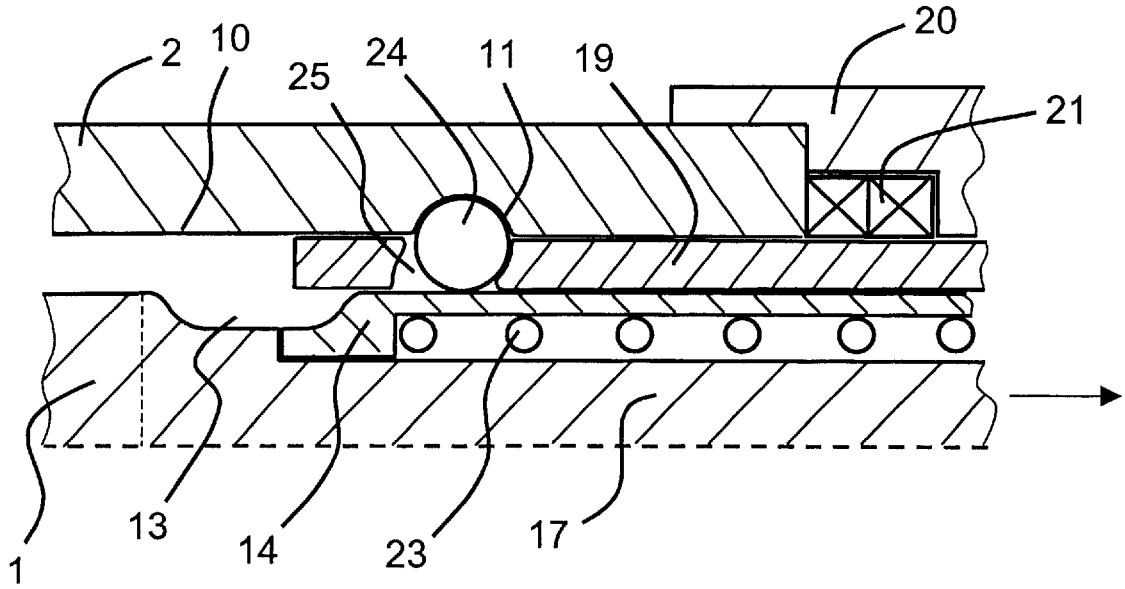
FIG. 8 shows an enlarged view of the mechanism immediately before the stage illustrated in FIG. 2.

During a first stage of circuit-breaker opening (see FIGS. 2 and 8), the rod 1 moves rightwards as shown in, thereby causing the spring 22 to be compressed between the shoulder 12 on the rod 1 and the shoulder 9 in the tube 2 which has remained stationary in the direction A because it is locked by the action of the ball 24 engaged it the groove 11 and in the hold 25. The fingers 5 are still plugged onto the conductive plug 5'. As it continues to move rightwards, the shoulder 12 on the rod 1 comes into abutment against the edge of the step 8 in the tube 2 at the same time as the groove 13 in the rod 1 faces the hole 25 in the tube 19.

Figure 3:
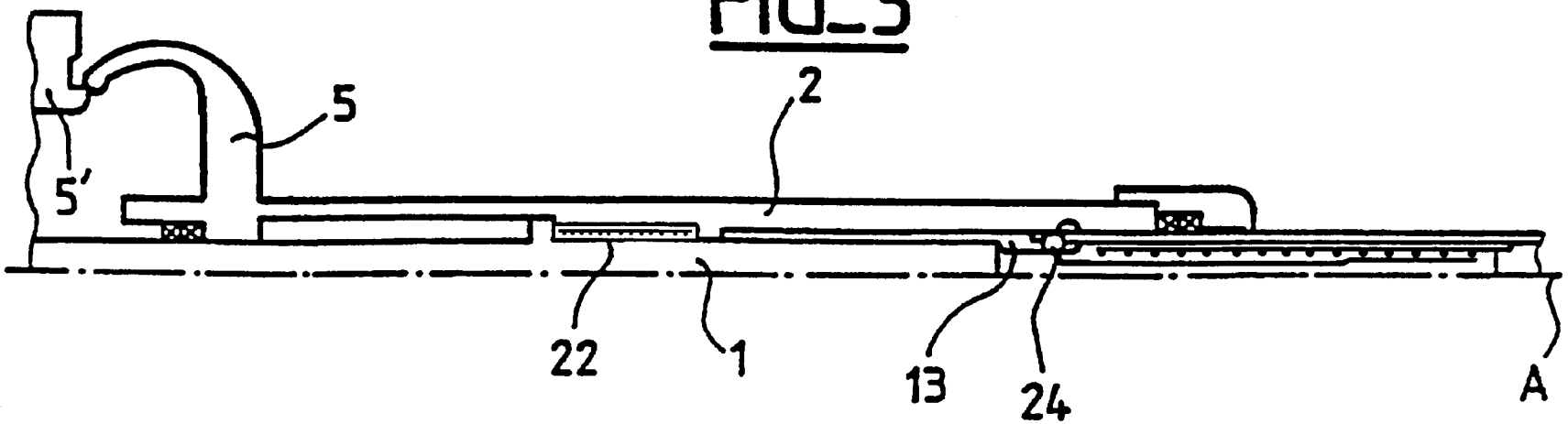
Figure 9:
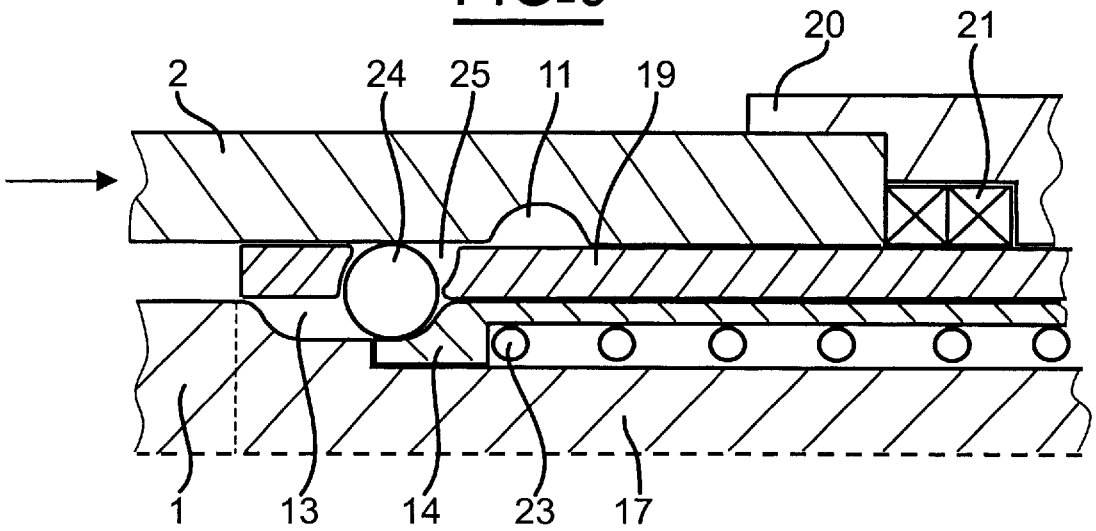
FIG. 9 shows an enlarged view of the mechanism in FIG. 3.

As shown in FIGS. 3 and 9, during a second stage of opening, the combined rightward displacement of the rod 1 and of the tube 2 forces the ball 24 to retract into the groove 13, thereby releasing the tube 2 so that it can be displaced in the direction A. Whereupon, the fingers 5 separate from the conductive plug 5'.

Figure 4:
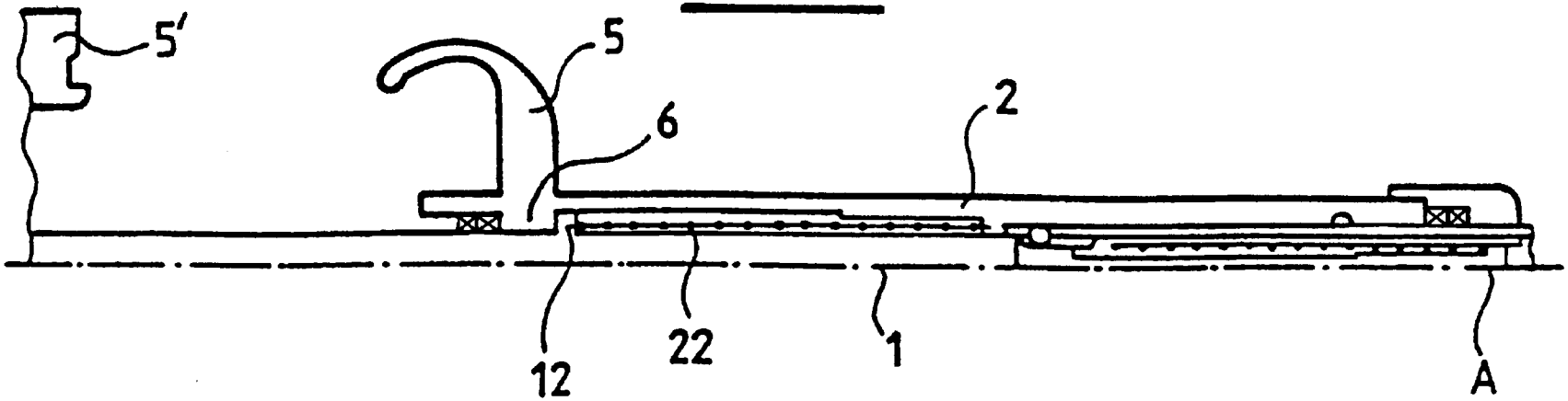

As shown in FIG. 4, the rod 1 continues to be displaced in the direction A towards the right of the figure, and the previously-compressed spring 22 relaxes and exerts a return force which tends to displace the tube 2 rightward. The tube 2 thus slides on the rod 1 until the shoulder 6 comes into abutment against the shoulder 12. The stroke of the tube 2 along the rod 1 must be set so that the fingers 5 are electrically isolated from the conductive plug 5'. The mechanism is then ready for a closure operation during which the resistor is inserted.

Figure 5:
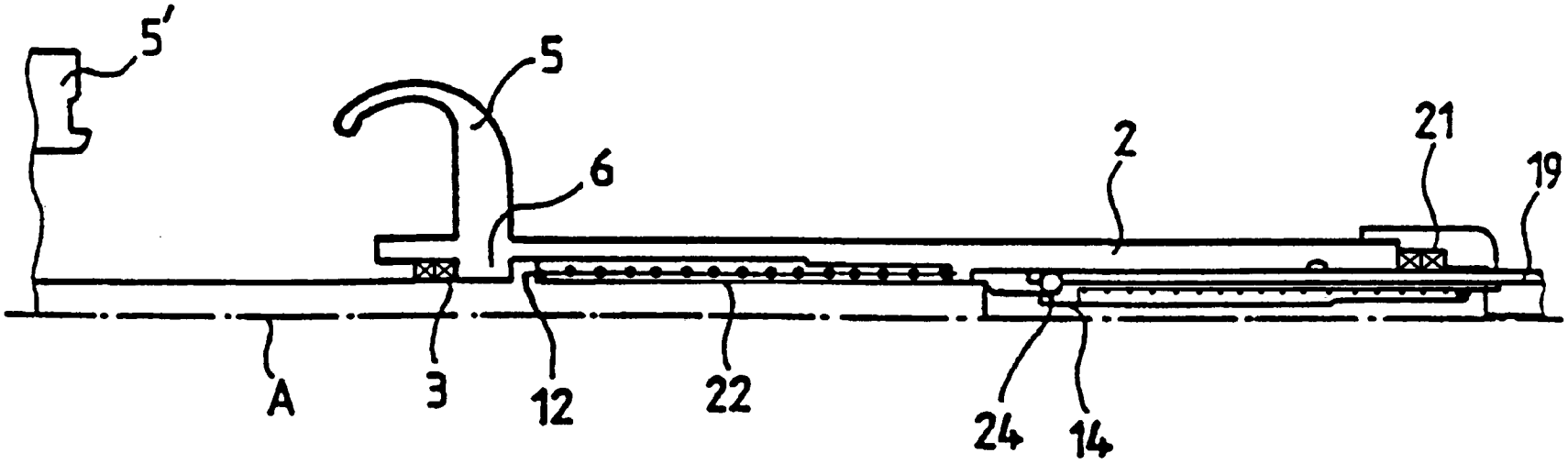
FIGS. 5 to 7 are very diagrammatic views of the mechanism for inserting the resistor during various stages of switch closure.

As shown in FIG. 5, during a first stage of closure, the rod 1 is pulled leftwards as shown in the figures, and it entrains the tube 2 in the same direction by means of the action of the shoulder 12 provided on the rod 1, which shoulder comes into abutment against the shoulder 6 in the tube 2. During this closure stage, the arcing contacts of the circuit-breaker move towards each other at the same time as the fingers 5 move towards the plug 5'. When the electrical arc strikes between the arcing contacts, the resistor is inserted because the current flows via the rod 1, the sliding contacts 3, the tube 2, the sliding contacts 21, and the tube 19.

Figure 6:
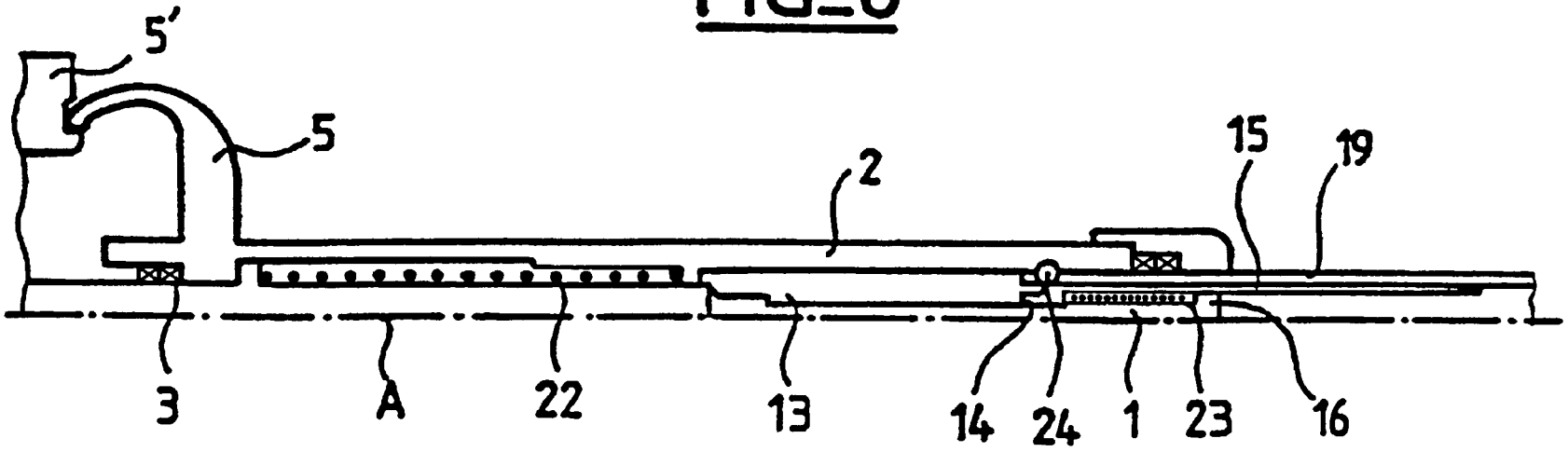

As shown in FIG. 6, the combined displacement of the rod 1 and of the tube continues, and the fingers 5 are then plugged onto the plug 5', thereby short-circuiting the resistor because the current then flows via the rod 1, the sliding contacts 3, the fingers 5, and the plug 5'. During this combined displacement of the rod 1 and of the tube 2, the ball 24 remains stationary in the direction A because it in locked in the hole 25 in the stationary tube 19 and in the groove 13 in the rod 1. As shown in FIG. 6, during this combined displacement of the rod 1 and of the tube 2, the rear edge of the groove 13, which edge is constituted by the rounded end of the tubular piece 14, remains stationary in the direction A, and thus causes the spring 23 to be compressed against the end wall of the bore 15 in the tubular piece 14 and against the shoulder 16 on the rod 1.

Figure 7:
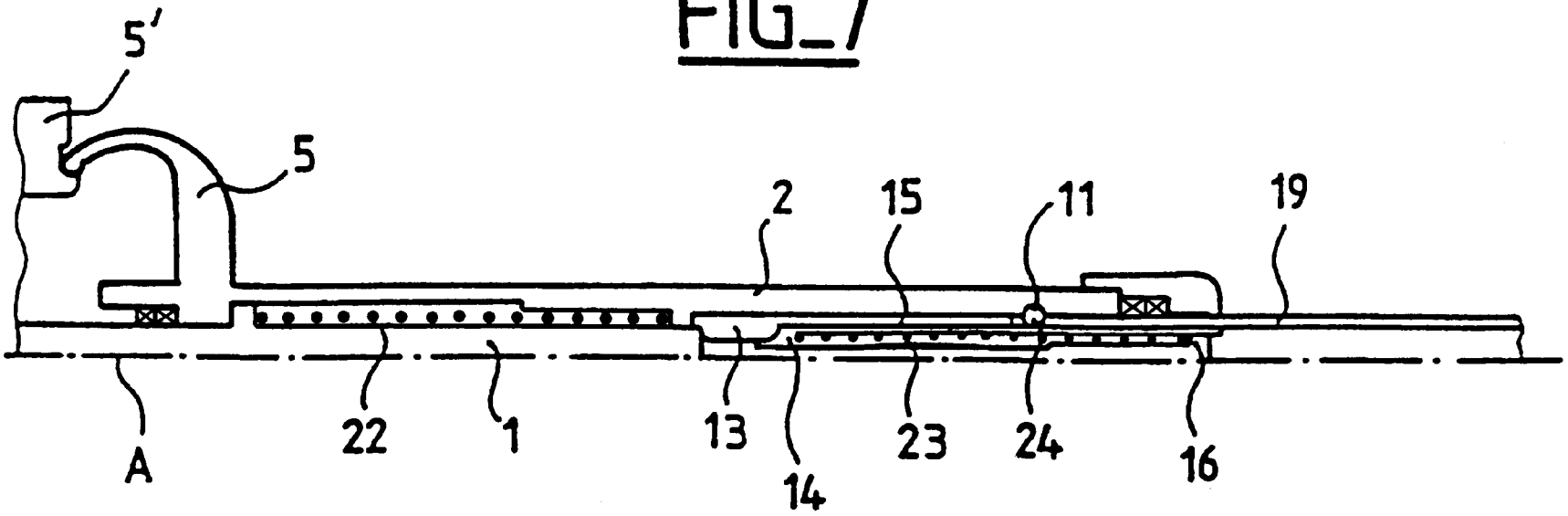

As shown in FIG. 7, as soon as the groove 11 in the tube 2 faces the hole 25 in the stationary tube 19, the ball 24 can be released from the groove 13 and can retract into the groove 11, thereby unlocking the tubular piece 14 so that it can be displaced. The previously-compressed spring 23 can thus relax, and it exerts a return force which drives the tubular piece 14 leftwards. The tubular piece 14 therefore slides under the ball 24 so as to maintain the tube 2 locked so that it is prevented from moving in the direction A, and the mechanism is then ready for another opening operation.

What is claimed is:

1. A mechanism for inserting a closure resistor for an electrical switch containing a semi-moving arcing contact mounted to be semi-movable in an axial direction and secured to a metal rod which extends in said axial direction between the arcing contact and the resistor, the mechanism comprising:

a metal tube coaxial with the rod and mounted to slide in electrical contact thereon, said tube having an end that plugs onto a conductive plug of the switch so as to short-circuit the resistor;

a spring disposed between a first shoulder provided on the rod and a second shoulder provided on said tube so as to be compressed during a first stage of switch opening, and so as to exert a return force on said tube to displace said tube in said axial direction in order to separate said tube from said plug during a second stage of switch opening subsequent to the first stage; and a ball-locking system having at least one ball disposed in a first groove on said tube which locks said tube so as to prevent said tube from being displaced in said axial direction during the first opening stage, wherein said at least one ball retracts into a second groove on the rod during the second opening stage so as to release said tube so that said tube can be displaced in said axial direction.

2. The mechanism according to claim 1, in which said ball-locking system further comprises a first tubular piece which is stationary in said axial direction and which is disposed coaxially with said tube between said tube and the rod, a hole in said tubular piece which faces the first groove when the switch is in the closed position, wherein said at least one ball engages in said groove and in the hole so as to lock the tube so as to prevent the tube from being displaced in said axial direction during the first opening stage, wherein said second groove is provided in the rod into which said at least one ball retracts during the second opening stage.

3. The mechanism according to claim 2, wherein the second groove provided in the rod has an edge that slides in said axial direction, said edge being constituted by a second tubular piece coaxial with the rod and mounted to slide along the rod, a second spring being disposed between a third shoulder provided in said second tubular piece and a fourth shoulder provided on the rod so as to be compressed during a first stage of switch closure until the first groove provided in the metal tube faces the hole provided in the first tubular piece, the return force exerted by said second spring serving to engage the ball in said hole in the first tubular piece and in said first groove in the metal tube, and to displace said second tubular piece in the axial direction.

4. A mechanism for inserting a closure resistor for an electrical switch containing a semi-moving arcing contact mounted to be semi-movable in an axial direction and secured to a metal rod which extends in said axial direction between the arcing contact and the resistor, the mechanism comprising:

a metal tube coaxial with the rod and mounted to slide in electrical contact thereon, said tube having an end that plugs onto a conductive plug of the switch so as to short-circuit the resistor;

a spring disposed between a first shoulder provided on the rod and a second shoulder provided on said tube so as to be compressed during a first stage of switch opening, and so as to exert a return force on said tube to displace said tube in said axial direction in order to separate said tube from said plug during a second stage of switch opening subsequent to the first stage; and a ball-locking means for locking said tube in said axial direction during the first opening stage, and for releasing said tube during the second opening stage so that said tube can be displaced in said axial direction.

* * * * *